US008348277B2

(12) United States Patent
Fitoussi et al.

(10) Patent No.: US 8,348,277 B2
(45) Date of Patent: Jan. 8, 2013

(54) ROULETTE GAME SYSTEM AND METHOD OF PLAY

(75) Inventors: Richar Fitoussi, Las Vegas, NV (US); Peter Skinner, London (GB)

(73) Assignee: Richar Fitoussi, Las Vegas, NV (US)

( * ) Notice: Subject to any disclaimer, the term of this patent is extended or adjusted under 35 U.S.C. 154(b) by 231 days.

(21) Appl. No.: 12/796,912

(22) Filed: Jun. 9, 2010

(65) Prior Publication Data

US 2011/0180990 A1 Jul. 28, 2011

Related U.S. Application Data

(60) Provisional application No. 61/298,132, filed on Jan. 25, 2010.

(51) Int. Cl.
*A63F 5/00* (2006.01)

(52) U.S. Cl. ..... 273/142 E; 273/142 HA; 273/142 J; 463/17

(58) Field of Classification Search ..... 273/142 E, 273/142 F, 142 H, 142 HA, 142 J, 142 JA–142 JD, 273/142 K; 463/17
See application file for complete search history.

(56) References Cited

U.S. PATENT DOCUMENTS

| | | | | |
|---|---|---|---|---|
| 5,636,838 | A | 6/1997 | Caro | |
| 6,083,105 | A * | 7/2000 | Ronin et al. | 463/17 |
| 6,164,647 | A | 12/2000 | Chee | |
| 2008/0214264 | A1 | 9/2008 | Griswold et al. | |

FOREIGN PATENT DOCUMENTS

DE 9015905 U1 2/1991

* cited by examiner

*Primary Examiner* — Benjamin Layno
(74) *Attorney, Agent, or Firm* — Greenberg Traurig

(57) ABSTRACT

A conventional roulette wheel modified to include a set of roulette numbers depicted on an inner rotatable unit which like another set of roulette numbers depicted on an outer rotatable ring serve to identify a ball compartment such that a ball compartment into which the roulette ball ultimately lands is identified by two roulette numbers increasing the number of wager options for players including a high-paying bonus wager. Various systems for ensuring alignment of the outer and/or inner sets of roulette numbers with the ball compartments are disclosed.

13 Claims, 21 Drawing Sheets

607

| | | |
|---|---|---|
| A | 2 to 1 | Any twelve numbers |
| B | 5 to 1 | Any six numbers |
| C | 8 to 1 | Any four numbers |
| D | 11 to 1 | Any three numbers |

| | | |
|---|---|---|
| E | 17 to 1 | Any two numbers |
| F | 35 to 1 | Any single number |
| G | 4 to 1 | Any seven numbers (0) |
| | 3 to 1 | Any eight numbers (00) |

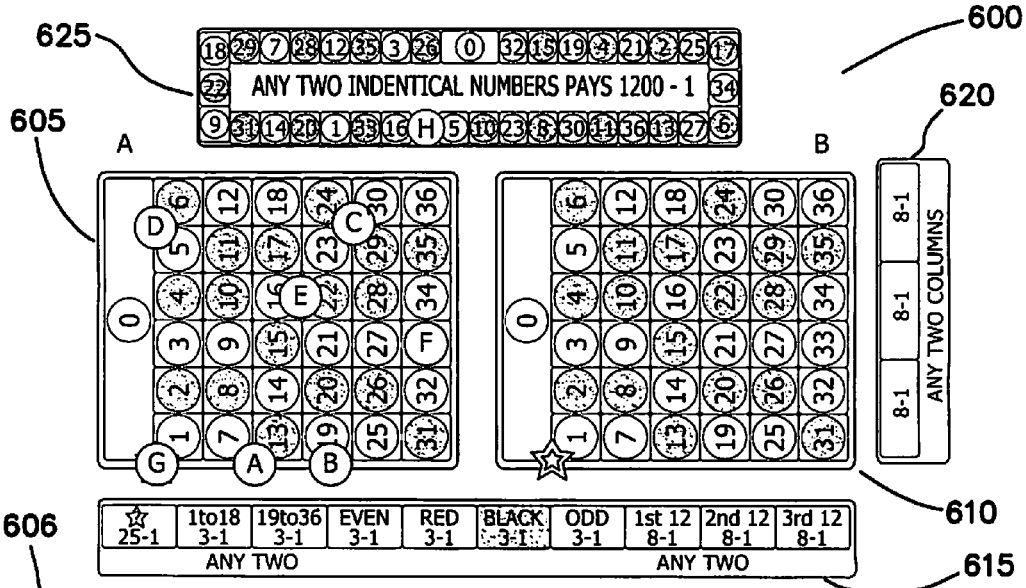

Double Action™ Track and Outside Boxes - Bet on Two Outcomes

608

| | | | |
|---|---|---|---|
| Any two - ☐ Red | 3 to 1 | Any two - 1st Dozen | 8 to 1 |
| Any two - ☒ Black | 3 to 1 | Any two - 2nd Dozen | 8 to 1 |
| Any two - Even | 3 to 1 | Any two - 3rd Dozen | 8 to 1 |
| Any two - Odd | 3 to 1 | Any two - 1st Column | 8 to 1 |
| Any two - 1 to 18 | 3 to 1 | Any two - 2nd Column | 8 to 1 |
| Any two - 19 to 36 | 3 to 1 | Any two - 3rd Column | 8 to 1 |

| | | | |
|---|---|---|---|
| Double Action™ Track (H) | 1200 to 1 | Any two - ☆ 8 Numbers (00) | 18 to 1 |
| Any two identical numbers | | Any two - ☆ 7 Numbers (0) | 25 to 1 |

611 612

FIG. 7

ROULETTE GAME SYSTEM AND METHOD OF PLAY

CROSS-REFERENCE TO RELATED APPLICATIONS

This application claims the benefit of U.S. Provisional Patent Application No. 61/298,132 filed Jan. 25, 2010 and incorporates the same for all purposes.

FIELD OF THE INVENTION

The embodiments of the present invention relate to a roulette system having two sets of roulette numbers on a single roulette wheel system allowing players to place wagers on two sets of numbers with a single ball roll.

BACKGROUND

Roulette has remained basically unchanged since its inception in the 18$^{th}$ century. Despite the maturity of roulette, the game remains popular in casinos throughout the world. Nonetheless, there is always a need to add excitement to current casino games to increase their popularity with players and increase traffic at casinos.

Accordingly, the embodiments of the present invention are directed to a modified roulette wheel system having two sets of roulette numbers positioned about a single set of roulette ball compartments. In this manner, players are permitted to place wagers on multiple roulette wager layouts during a single spin of the roulette wheel. Advantageously, certain wagers provide players with larger payouts than those traditionally possible with roulette.

SUMMARY

Accordingly, the embodiments of the present invention incorporate two sets of roulette numbers positioned on each side of a single set of ball compartments and means for aligning the two sets of roulette numbers with the ball compartments such that a single number from each set of roulette numbers identify the same ball compartment. An inner set of roulette numbers is located adjacent to the ball compartments on a cone assembly supported by an inner ring known as a separator ring and rotate as a single unit such that the inner roulette numbers are matched to a specific ball compartment (i.e., the inner roulette numbers are permanently aligned with the ball compartments). An outer set of roulette numbers is depicted on an outer ring which rotates independently of the separator ring or inner plate whereby alignment of the outer roulette numbers with the ball compartments is mechanically facilitated by the system embodiments of the present invention. In other embodiments, the outer roulette numbers are permanently aligned with the ball compartments such that the alignment mechanism ensures the inner roulette numbers align with the ball compartments.

In one embodiment, an alignment mechanism includes a cylindrical plunger including a deep groove ball bearing biased by a compression or leaf spring whereby the biasing of the spring forces the plunger to contact recesses, forming part of the inner ring, until the plunger stays within a recess thereby aligning the outer set of the roulette numbers with the ball compartments.

In another embodiment, an alignment mechanism includes a flat plunger biased by a compression or leaf spring whereby the biasing of the spring forces the plunger to contact gear teeth forming part of the inner ring as the inner ring rotates until the plunger comes to rest within a space defined by adjacent gear teeth thereby aligning the outer roulette numbers with the ball compartments.

In another embodiment, an alignment mechanism comprises a ball plunger configured to rest within a series of cavities on a side or underside of the separator ring thereby aligning the outer set of the roulette numbers with the ball compartments.

In another embodiment, an alignment mechanism comprises a clutch member configured to contact a series of gear teeth associated with the inner ring thereby aligning the outer roulette numbers with the ball compartments.

In another embodiment, an alignment mechanism comprises a time release return unit which allows the inner ring to rotate independently of the outer ring for a time period after which the inner ring and outer ring engage and rotate together with the outer roulette numbers in alignment with the ball compartments.

The embodiments of the present invention facilitate additional wagering opportunities over conventional roulette without altering the conventional method of playing roulette. In other words, the roulette game is played in the same manner as conventional roulette albeit with additional wagering opportunities including, but not limited to, multiple separate number wagers corresponding to the inner and outer roulette numbers and combination wagers based on the relationship between the inner and outer roulette numbers which identify the single ball compartment in which the roulette ball ultimately lands. For example, a bonus wager may relate to the ball compartment being identified by the same inner and outer roulette number (e.g. 23).

Other variations, embodiments and features of the present invention will become evident from the following detailed description, drawings and claims.

BRIEF DESCRIPTION OF THE DRAWINGS

FIG. 7 illustrates an exemplary wagering layout according to the embodiments of the present invention.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

Applicant incorporates herein by reference for all purposes U.S. Pat. No. 5,636,838 owned by applicant hereto. The embodiments of the present invention involve components of a conventional roulette wheel modified to include a set of roulette numbers depicted on a cone assembly supported by an inner ring which like another set of roulette numbers depicted on an outer ring serve to identify a ball compartment such that a ball compartment into which the roulette ball ultimately lands is identified by two roulette numbers increasing the number of wager options for players. The embodiments of the present invention are directed to various systems for ensuring alignment of the outer and/or inner sets of roulette numbers with the ball compartments. As described below, in one embodiment, the cone assembly depicts inner roulette numbers which permanently identify ball compartments. Those skilled in the art will recognize that the roulette wheel systems herein can also be reversed such that the outer roulette numbers permanently identify ball compartments.

Figure 1:
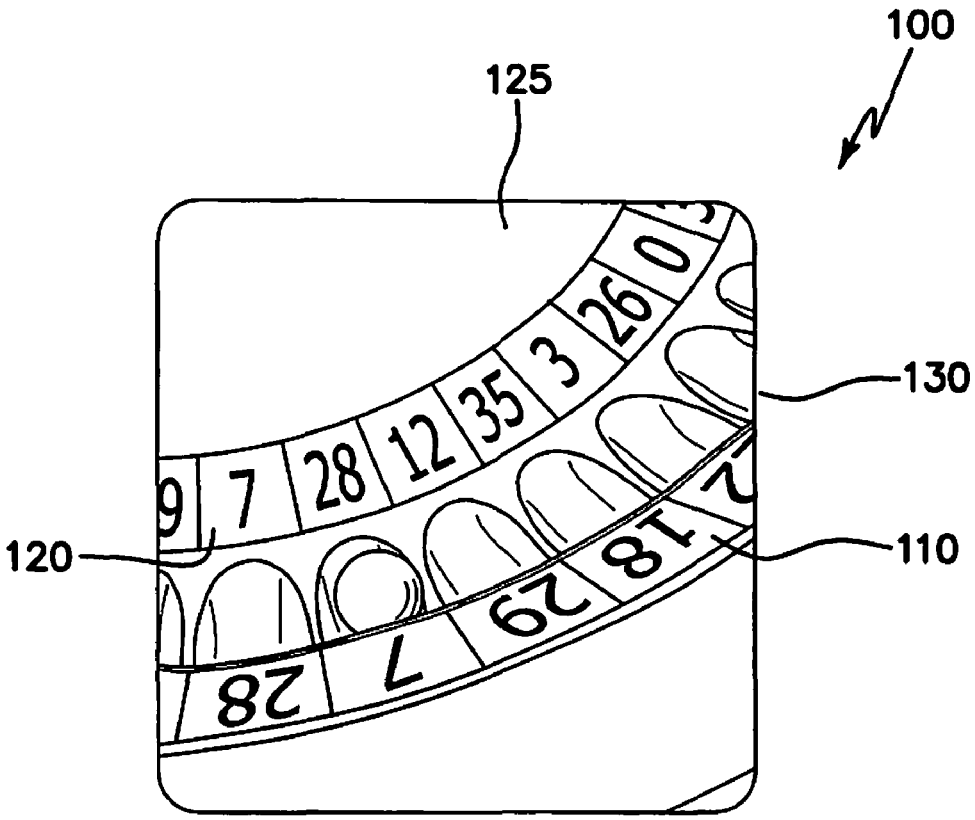
FIG. 1 shows a top view of a section of a roulette wheel according to the embodiments of the present invention.

Initial reference is made to FIG. 1 showing a top view of a roulette system 100 including ball compartments 105, outer roulette numbers 110 and inner roulette numbers 115. As shown, the ball compartment retaining the roulette ball 120 is identified by Red 7 from the outer roulette numbers 110 and Black 28 from the inner roulette numbers 115. The ball compartments 105 and inner roulette numbers 115 are both part of an inner unit 125 (cone assembly and separator ring) such that the inner roulette numbers 115 permanently identify a specific ball compartment 105. The outer roulette numbers 110 are depicted on an outer ring 130 which rotates independently of an inner separator ring. Thus as set forth above and detailed below, the embodiments of the present invention are directed to various systems for ensuring alignment of the outer roulette numbers 110 with the ball compartments 105 since the two are independent. Again, those skilled in the art will recognize that the roulette wheel systems herein can also be reversed such that the outer roulette numbers 110 permanently identify ball compartments 105 such that the inner separator ring and corresponding inner roulette numbers 115 need to be aligned.

In each of the embodiments of the present invention as related to at least live roulette tables, a base member contains the components (e.g., inner ring, cone assembly, outer ring, etc.) of the roulette wheel system.

Figure 2A:
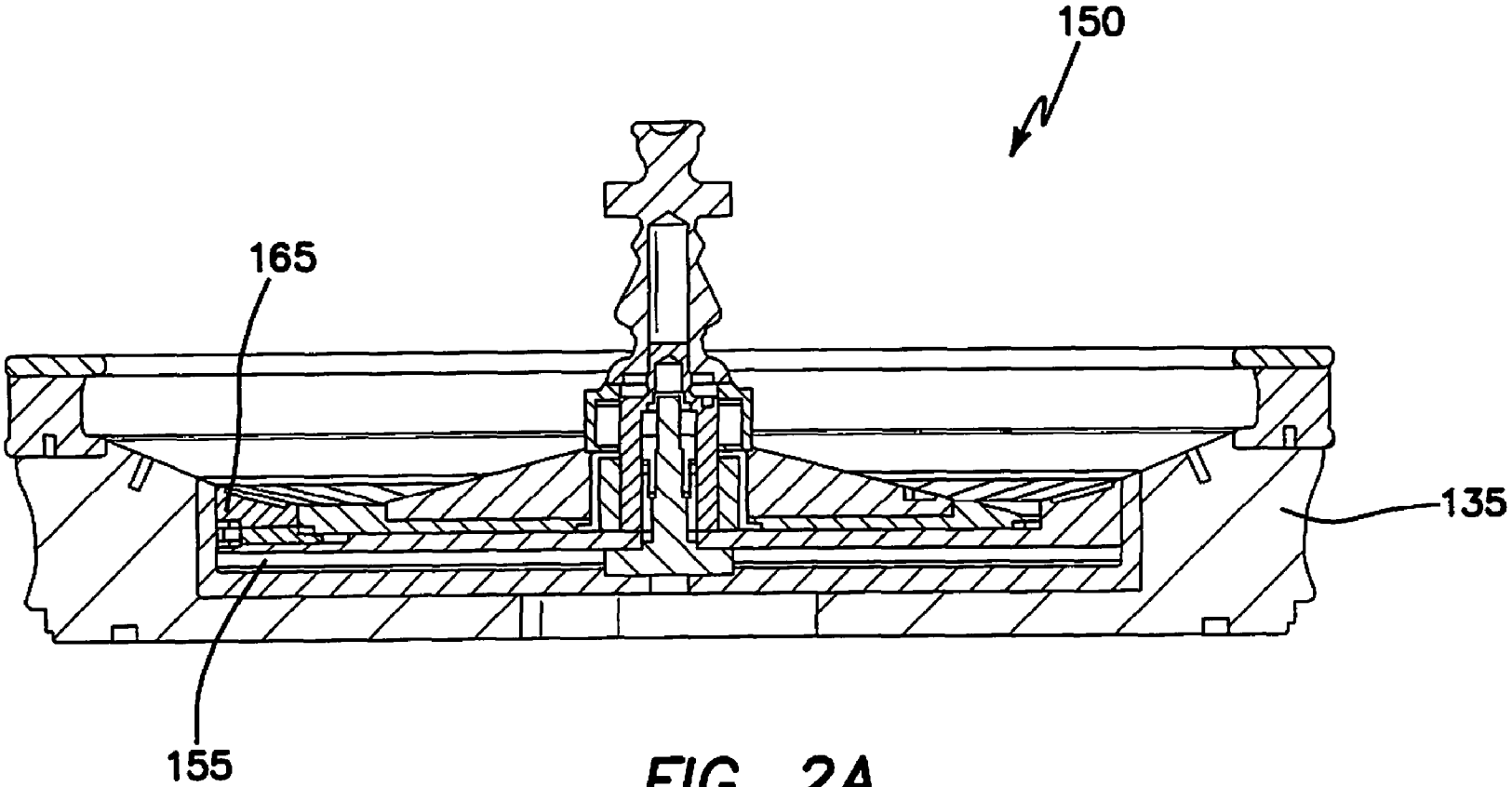
FIGS. 2*a*-2*j* illustrate a roulette wheel system, including a cylindrical plunger, according to one embodiment of the present invention.
Figure 2B:
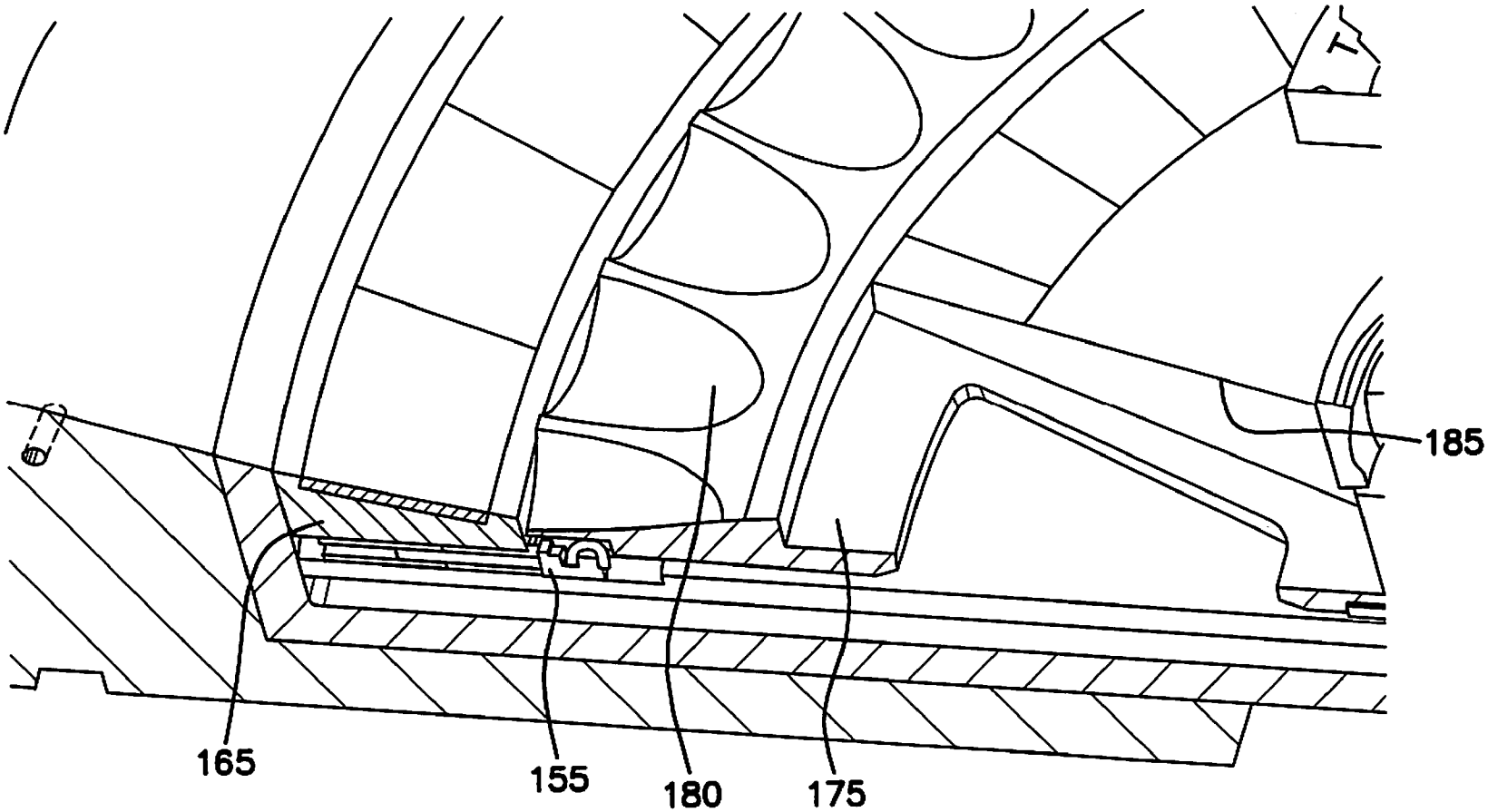
Figure 2C:
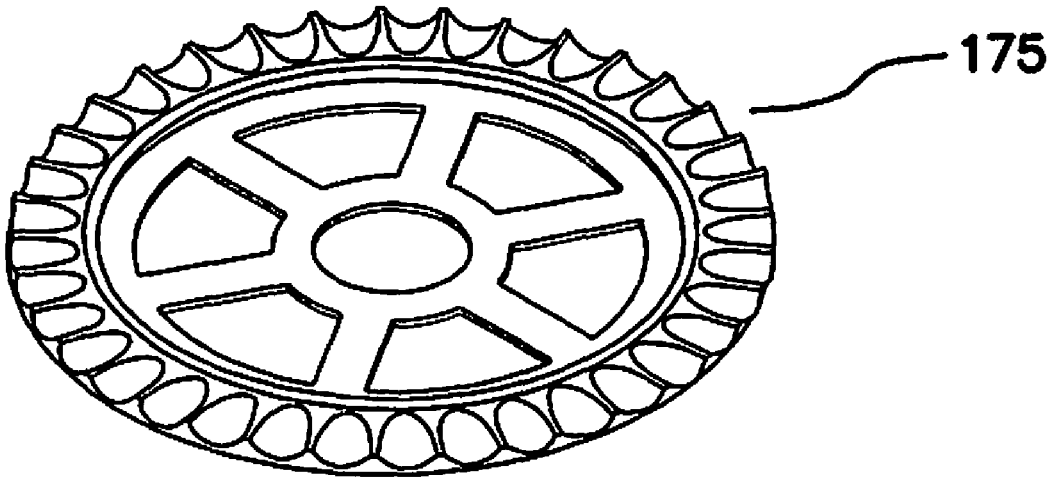
Figure 2D:
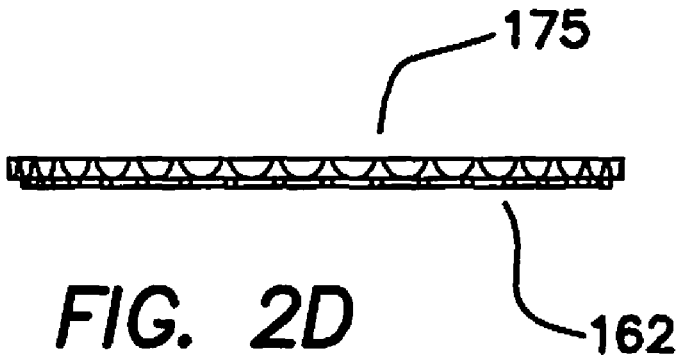
Figure 2E:
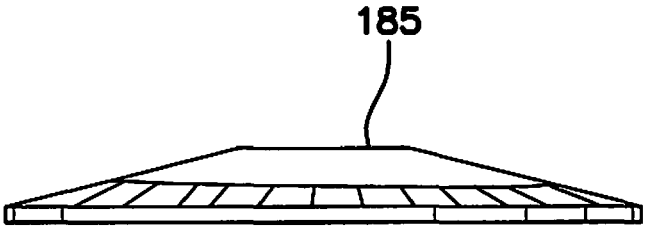
Figure 2F:
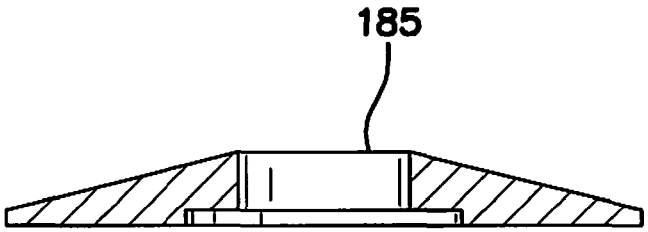
Figure 2G:
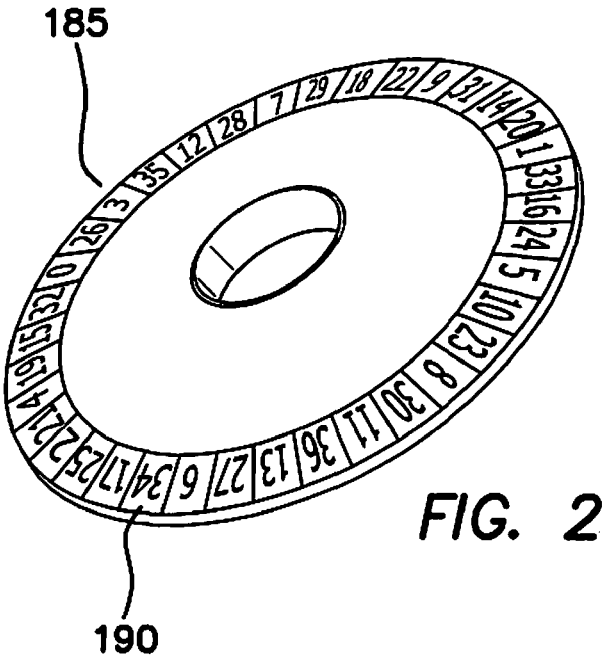

Reference is now made to FIGS. 2*a*-2*h* shows a roulette wheel system 150 according to the embodiments of the present invention wherein the roulette wheel system 150 includes a cylindrical plunger 155 mounted to, or formed as part of, an outer ring 165 depicting outer roulette numbers 160. A base member 135 contains the components of the roulette wheel system 150 and the other roulette wheel systems described below. In one embodiment, as shown in cross-sectional views of FIGS. 2*a* and 2*b*, the cylindrical plunger 155 is mounted to an underside of the outer ring 165 and rotates therewith. An inner unit comprises a separator ring 175 as shown in FIGS. 2*c* and 2*d*, with ball compartments 180, configured to support an inner cone assembly 185 (shown in FIGS. 2*e* through 2*g*) depicting inner roulette numbers 190. Independent ball bearing systems (not shown) allow the outer ring 165 and separator ring 175 to rotate independent of one another. The plunger 155 is positioned on the outer ring 165 such that alignment of the outer roulette numbers 180 with the ball compartments 180 is ensured once the outer ring 165 and separator ring 175 slow to appropriate speeds whereby the roulette ball has landed in one of the ball compartment 180. That is, the alignment occurs prior to the stoppage of the outer ring 165 and inner ring 175.

Figure 2H:
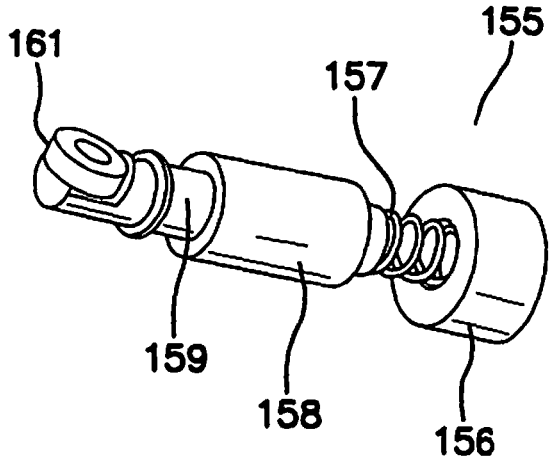
Figure 2I:
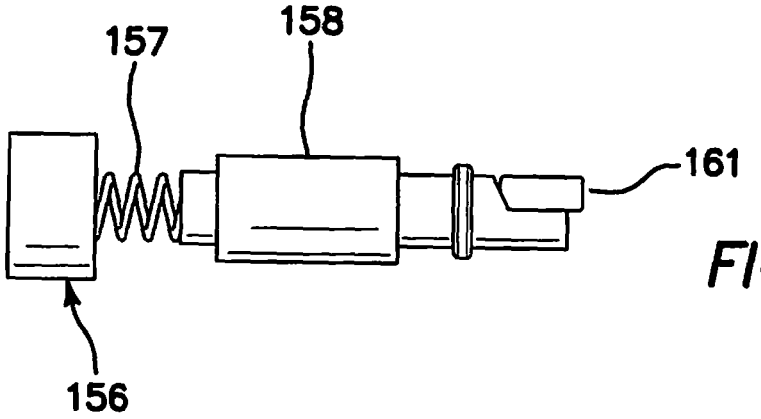
Figure 2J:
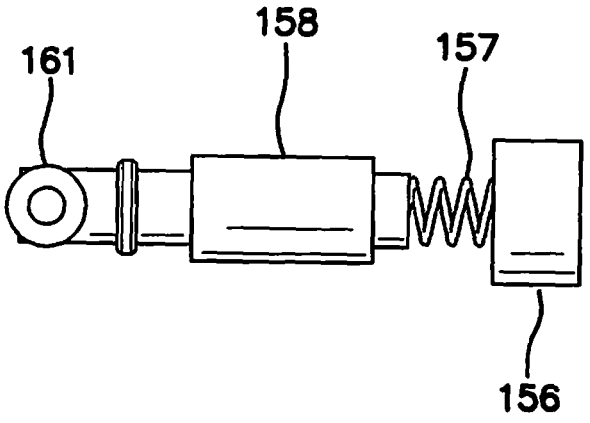

Now referring to FIGS. 2*h* through 2*j*, the cylindrical plunger 155 includes an adjuster cap 156, spring 157, bush 158, spindle 159 and bearing 161. The bearing end of the cylindrical plunger 155 is configured such that the bearing 161 contacts a series of recesses 162 of the separator ring 175. The spring 157 forces the bearing 161 into the recesses 162 such that ultimately the bearing 161 will come to rest in one of the recesses 162 of the separator ring 175 or a connected hub or plate thereby aligning the outer roulette numbers 160 with the ball compartments 180. The rotating bearing 161 is configured to reduce frictional forces between the cylindrical plunger 155 and the separator ring 175. That is, the cylindrical plunger 155 is not designed to slow down the rotating separator ring 175 but rather to ensure that the outer roulette numbers 160 align with the ball compartments 180. The adjuster cap 156 provides means for the user to adjust the force exerted by the spring 157.

Figure 3A:
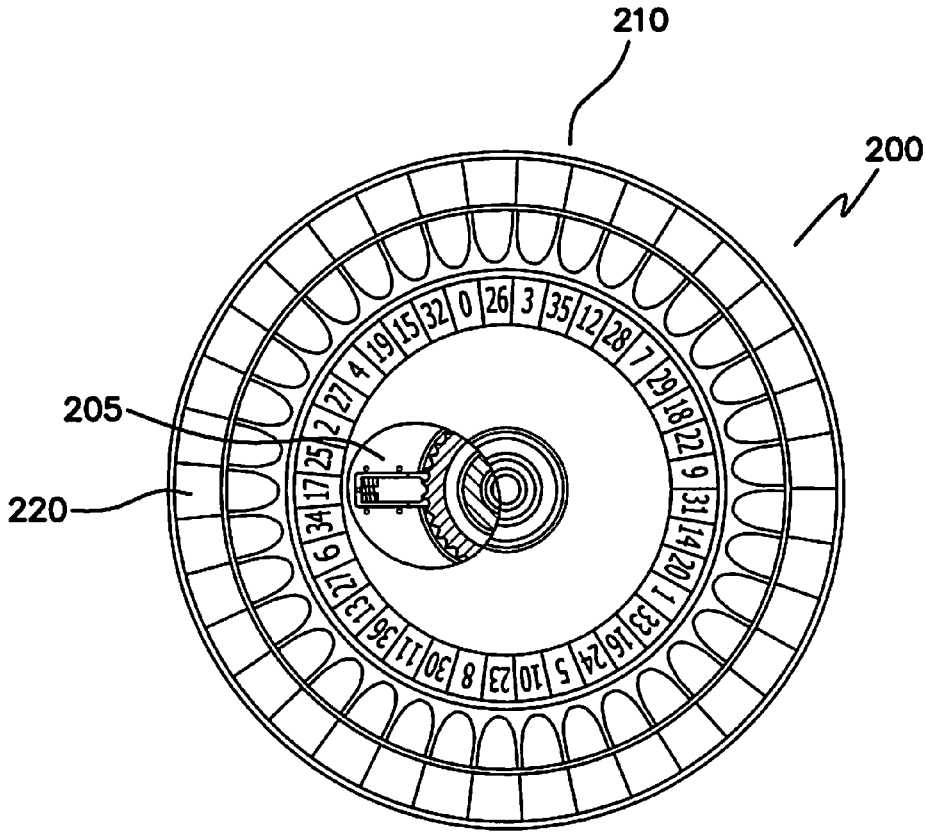
FIGS. 3*a*-3*i* illustrate a roulette wheel system, including a flat plunger, according to one embodiment of the present invention.
Figure 3B:
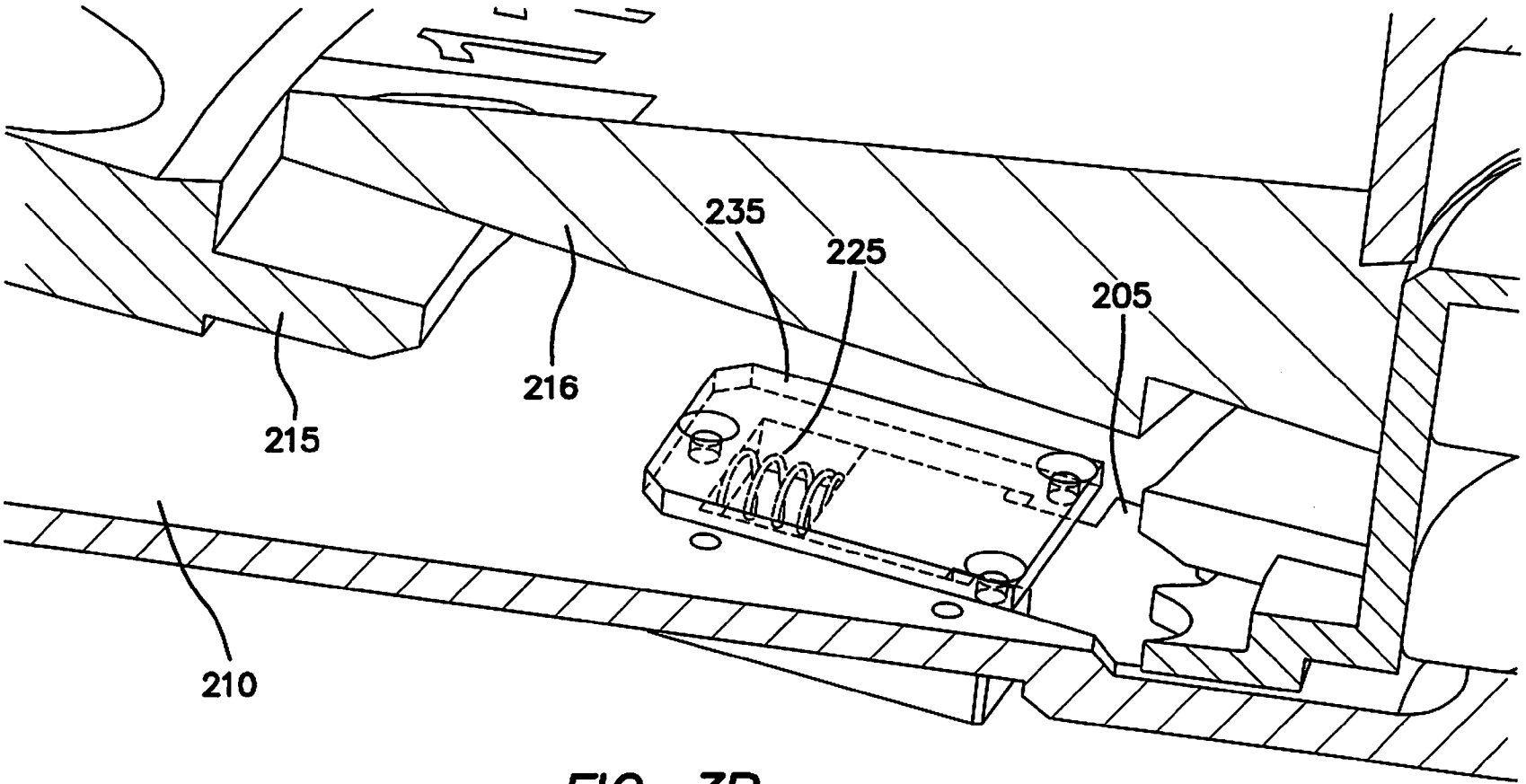
Figure 3C:
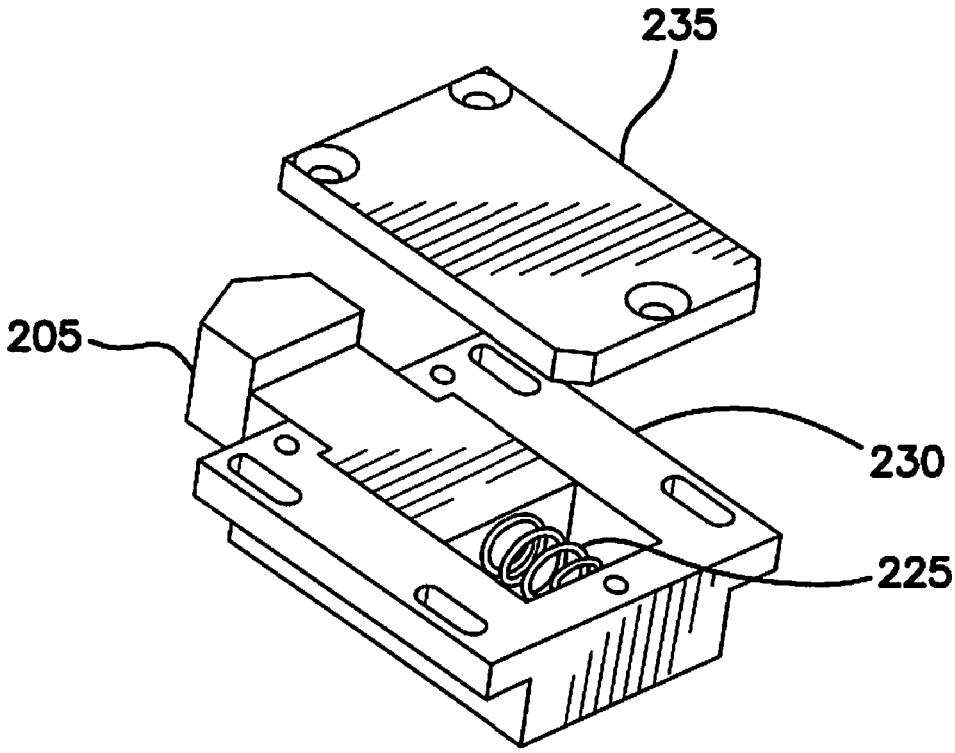
Figure 3D:
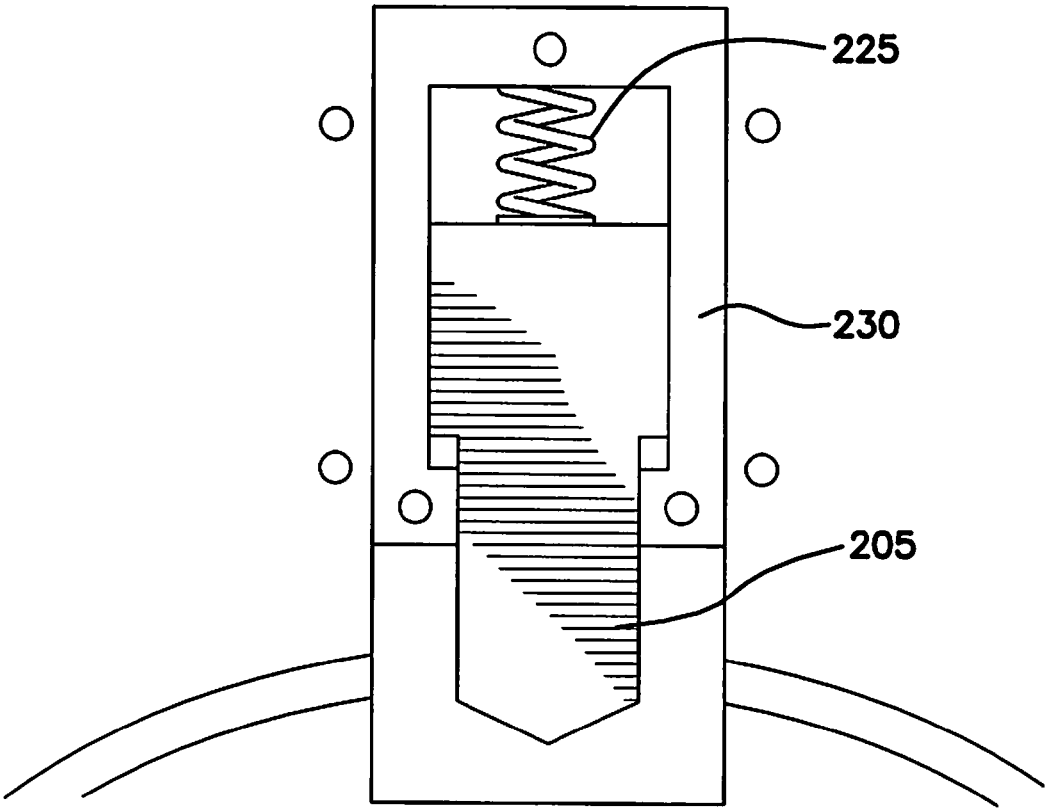
Figure 3E:
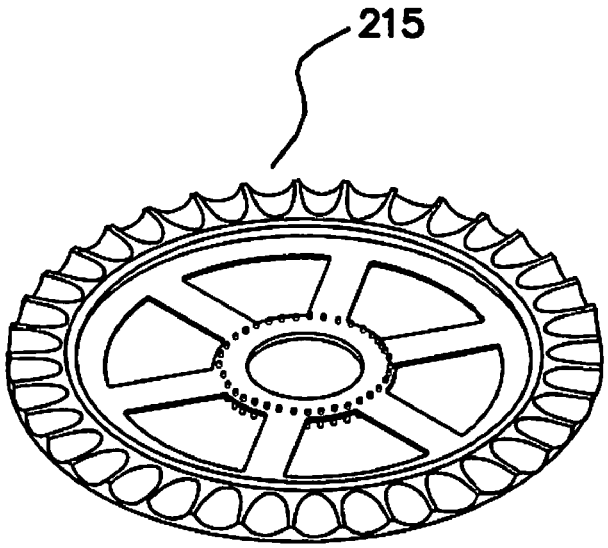
Figure 3F:
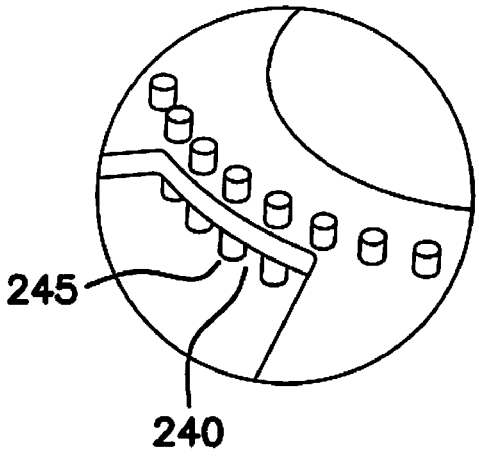
Figure 3G:
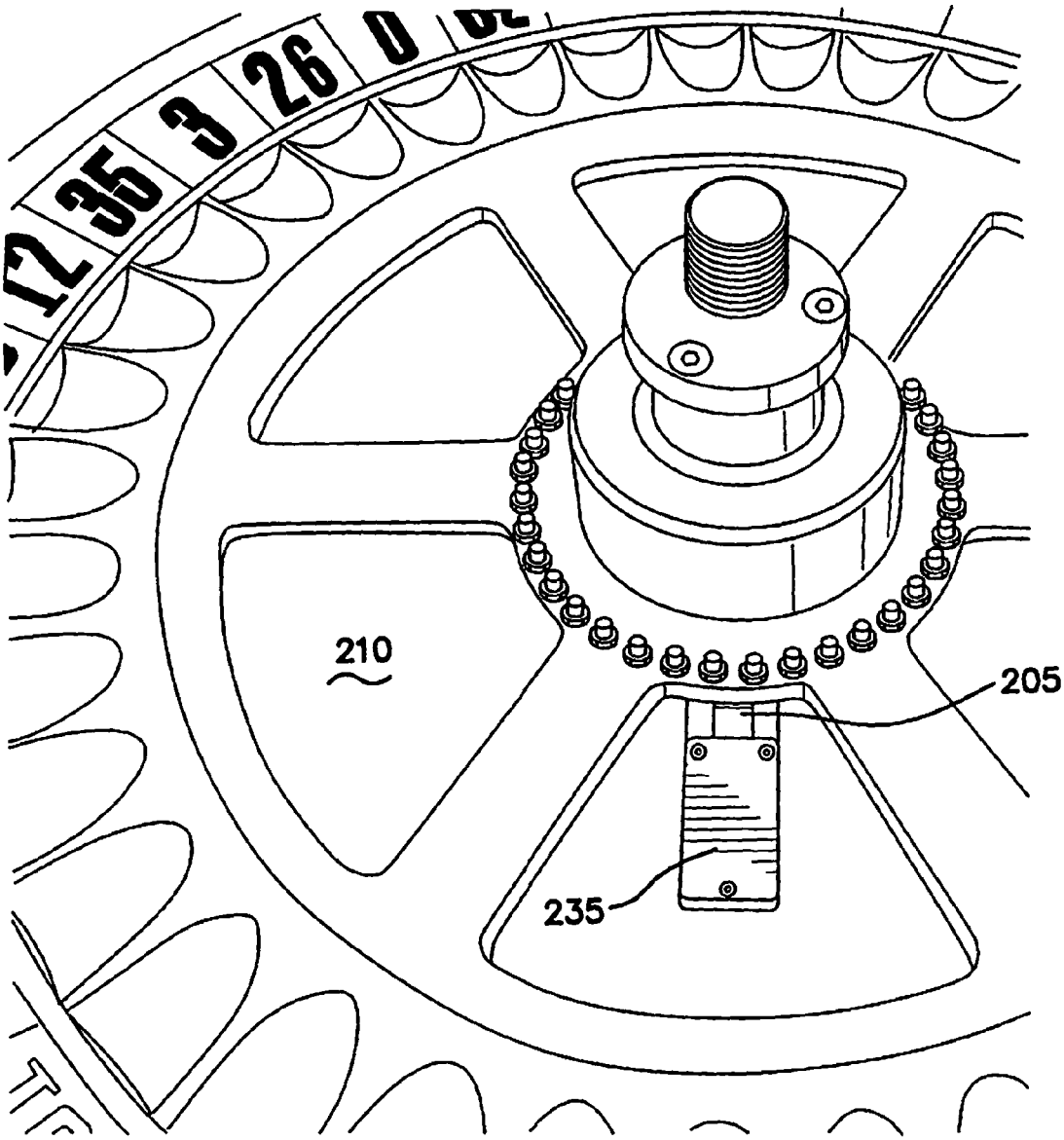

Reference is now made to FIGS. 3*a*-3*i* which show a roulette wheel system 200 according to the embodiments of the present invention wherein the roulette wheel system 200 includes a flat plunger 205 attached to, or formed as part of, an outer ring 210 depicting outer roulette numbers 220. FIGS. 3*a* and 3*b* show a top view and perspective view, respectively, of the roulette wheel system 200 showing the flat plunger 205 mounted, or formed as part of, the outer ring 210 and positioned to interact with a separator ring 215 and supported inner cone assembly 216. FIGS. 3*c* and 3*d* show the flat plunger 205, spring 225, housing 230 and cover plate 235. The spring 225 provides biasing to force the flat plunger 205, as shown in FIGS. 3*e* and 3*f*, into a series of spaces 240 defined by a plurality of pins 245 extending downward from the separator plate 215. FIG. 3*g* shows the flat plunger 205 in place on the outer ring 210. The plunger 205 may also interact with gear teeth and similar mechanical devices.

Figure 3H:
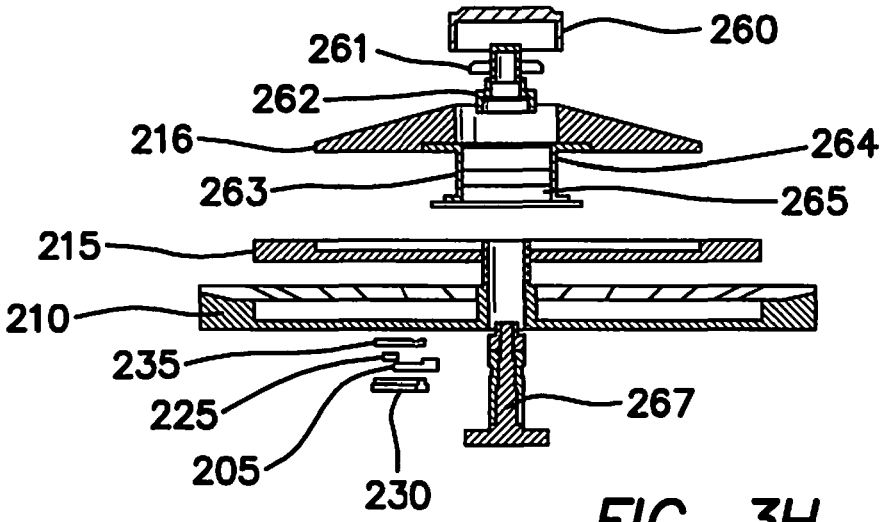
Figure 3I:
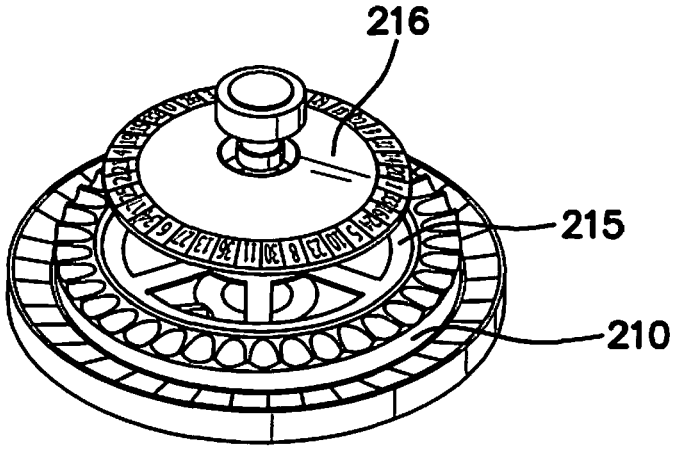

FIG. 3*h* shows a cross-sectional, exploded view of the roulette wheel system 200 and FIG. 3*i* shows an exploded perspective view. The roulette wheel system 200 comprises a turret base 260, turret stop 261, turret support 262, inner cone assembly 216, hub and alignment 263, primary bearing 264, secondary bearing 265, separator plate 215, outer ring 210, spindle 266, flat plunger 205, spring 225, housing 230, cover plate 235 and primary bearing assembly 267.

Figure 4A:
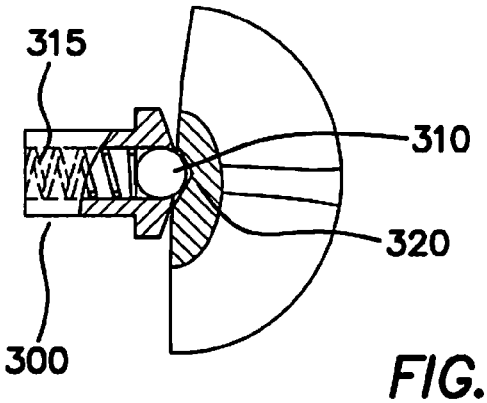
FIG. 4*a*-4*f* illustrate a roulette wheel system, including a ball plunger, according to the embodiments of the present invention.
Figure 4B:
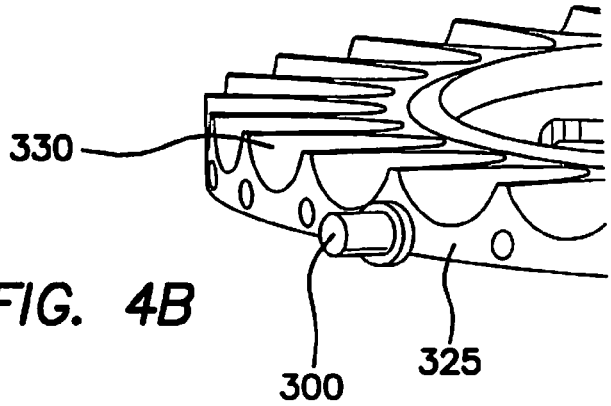
Figure 4C:
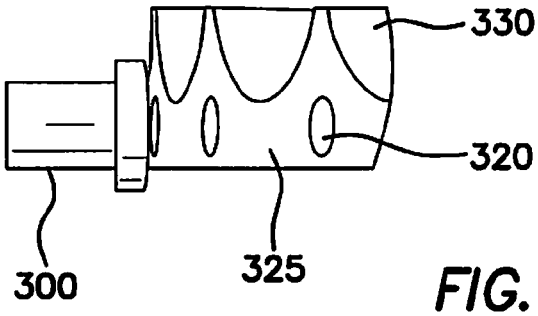
Figure 4D:
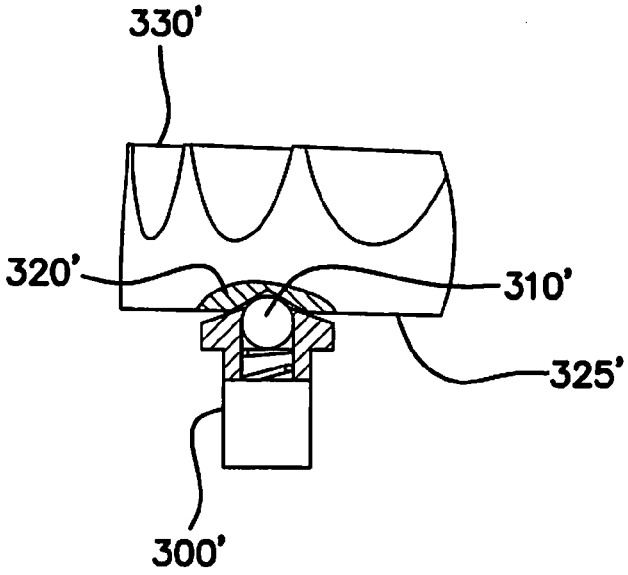
Figure 4E:
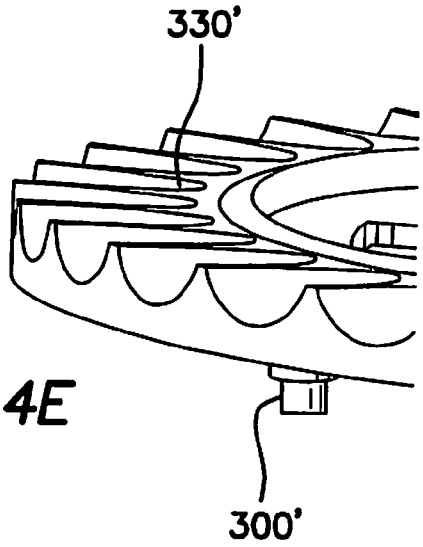
Figure 4F:
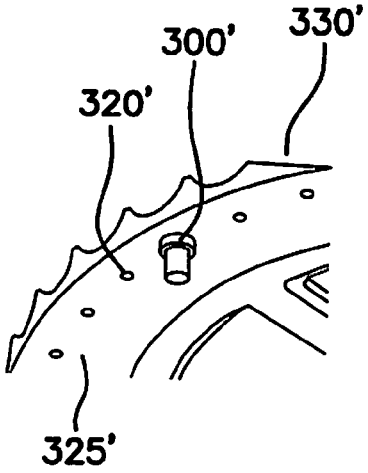
Figure 5A:
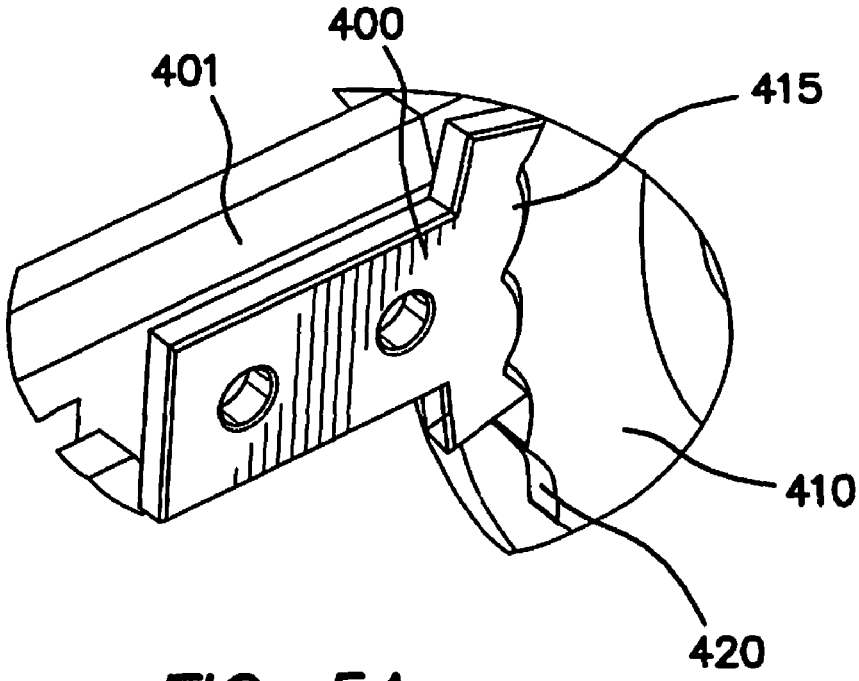
FIGS. 5*a*-5*d* illustrate a roulette wheel system, including a clutch member, according to the embodiments of the present invention.
Figure 5B:
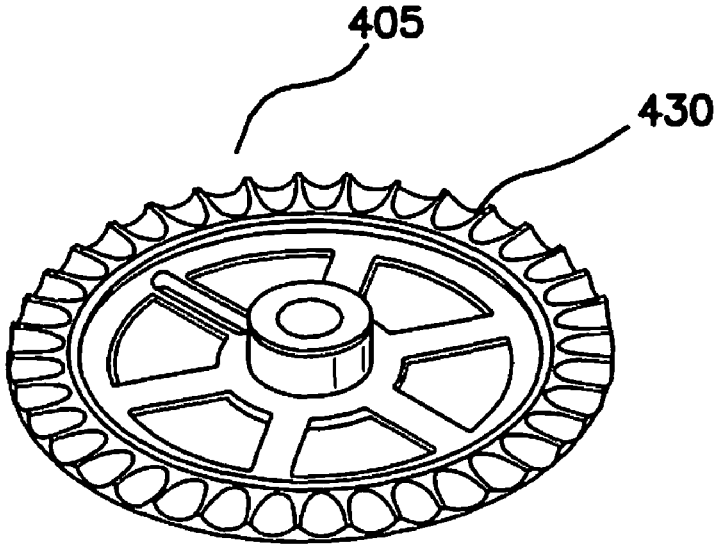
Figure 5C:
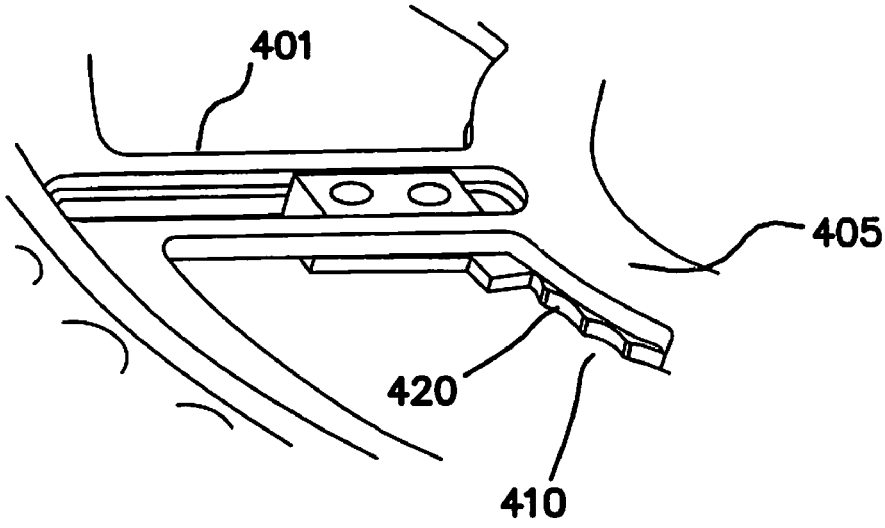
Figure 5D:
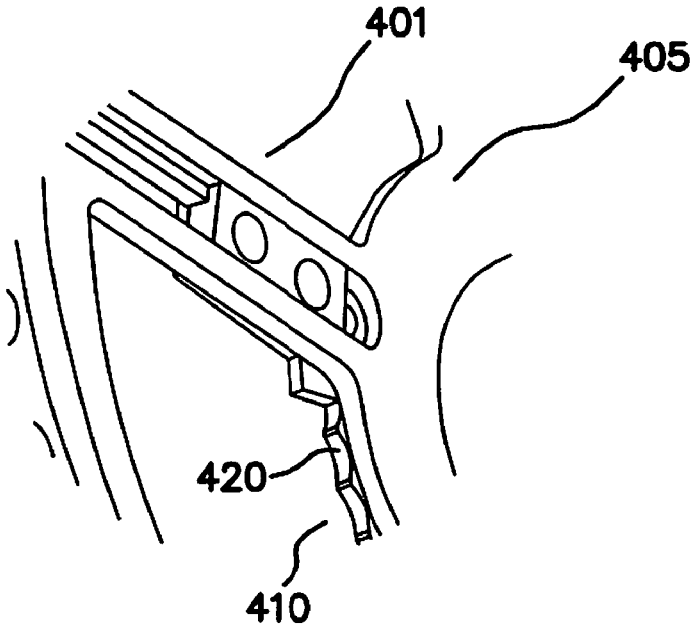

FIGS. 4*a* through 4*c* show a ball plunger embodiment of the present invention. The ball plunger mechanism 300 includes a cylindrical housing 305, ball 310 and spring 315 configured to urge the ball 310 into cavities 320 formed in a perimeter edge 325 of a separator ring 330. The ball plunger mechanism 300 is mounted horizontally to an outer ring in the manner detailed relative to the other embodiments of the present invention. FIGS. 4*d* through 4*f* show an alternative ball plunger embodiment of the present invention wherein the ball plunger mechanism 300' is configured to urge ball 310' into cavities 320' in a bottom surface 325' of the separator ring 330'. In this embodiment, the ball plunger mechanism 300' is mounted vertically to an outer ring in the manner detailed relative to the other embodiments of the present invention.

Now referring to FIGS. 5*a* through 5*d*, a centrifugal clutch member 400 slidably mounted to an arm 401 of the separator ring 405 and configured to engage a bearing hub 410 underneath the separator ring 405 wherein the bearing hub 410 forms part of the outer ring. Specifically, when in contact, a serrated edge 415 of the clutch member 400 engages a serrated perimeter 420 of the bearing hub 410. Mounting holes 425 allow the clutch member 400 to be positioned along the separator arm 401. When the inner wheel, including the separator ring 405 is spun, the centrifugal clutch member 400 tends to slide outward along the arm 401 such that the clutch member 400 and bearing hub 410 disengage allowing the inner ring and outer ring to spin independently of one another.

As the inner wheel slows down, centrifugal forces decrease and gravity urges the centrifugal clutch member 400 to slide inward along the arm 401 into engagement with the bearing hub 410 of the outer ring causing the outer and inner rings to rotate together. In one embodiment, the arm 401 may be sloped downward from the outer point to the inner point to allow gravity to more easily cause the clutch member 400 to slide into engagement with the bearing hub 410. In another embodiment, a biased spring (not shown) maintains the clutch member 400 in engagement with the bearing hub 410. In this instance, the spring force is not significant such that centrifugal forces are able to overcome the spring force at least initially until the rotational speed decreases at which time the spring force is able to force the clutch member 400 into engagement with the bearing hub 410.

Figure 6A:
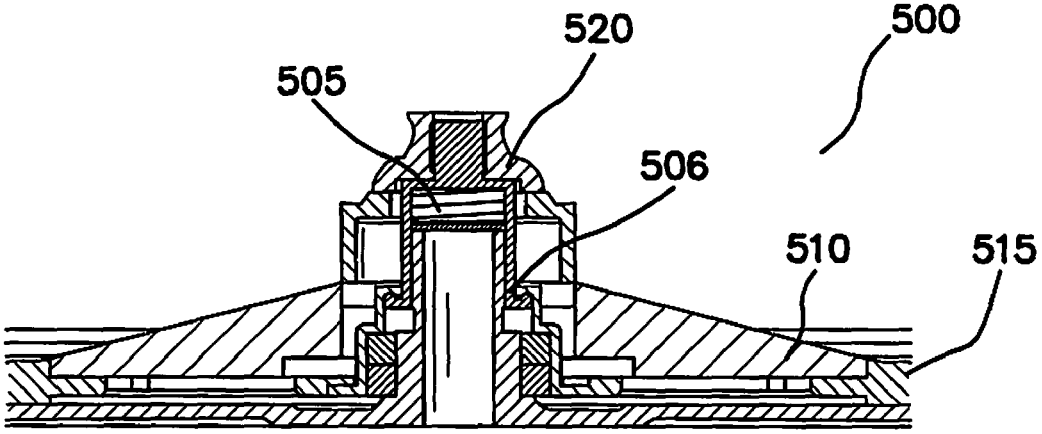
FIGS. 6*a*-6*c* illustrate a roulette wheel system, including a time release return unit, according to the embodiments of the present invention.
Figure 6B:
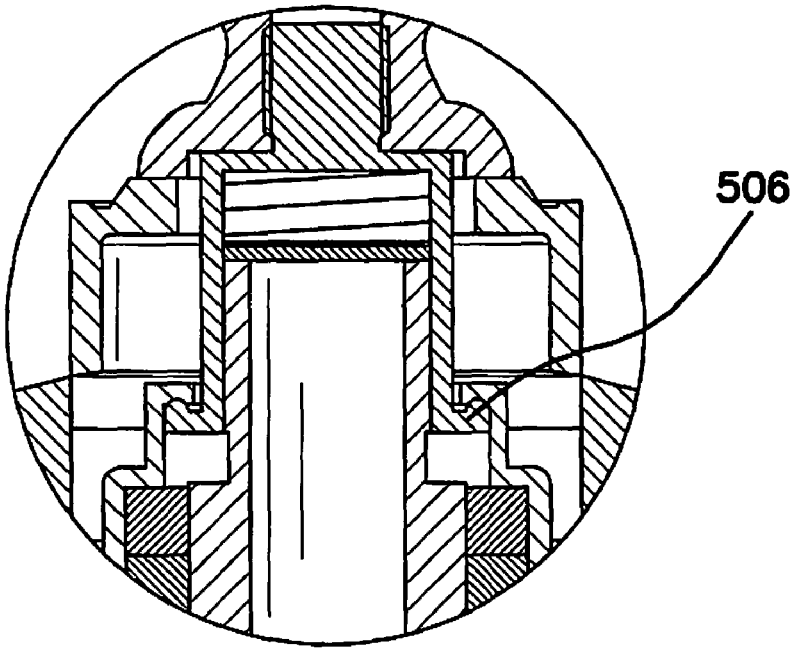
Figure 6C:
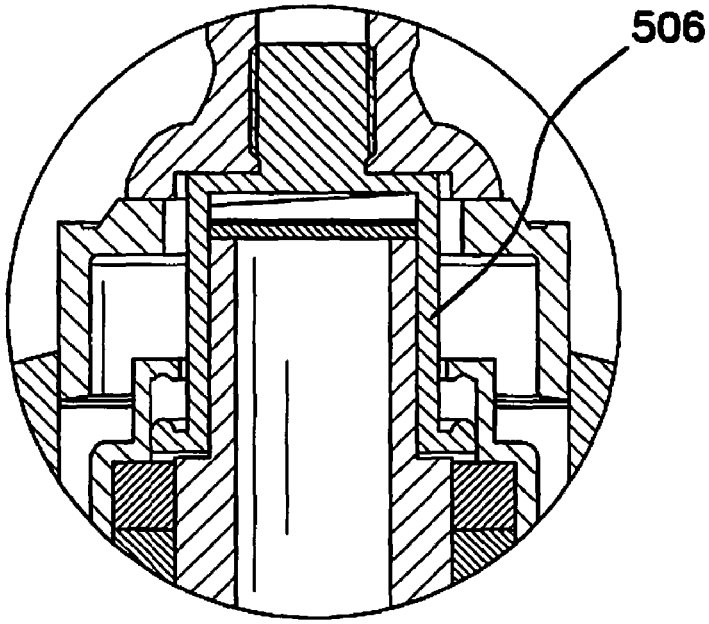

FIGS. 6*a* through 6*c* show an alternative embodiment of the roulette wheel assembly 500 utilizing a time control return unit 505. The time control return unit 505 allows the inner unit 510 and outer ring 515 to rotate independently of one another for a specified time period (e.g., 7-15 seconds) after which an automated alignment mechanism causes the outer roulette numbers to align with the ball compartments. The time control return unit 505 is positioned within the turret portion 520 of the roulette wheel assembly 500. Initially, the user depresses the turret portion 520 which lowers the lip 506 thereby disengaging the lip 506 from collar or sleeve 507 allowing the outer ring 515 and inner unit 510 to rotate independently of one another until the time control return unit 505 causes the lip 506 to raise thereby engaging the collar or sleeve 506 causing the outer ring 515 and inner unit 510 to rotate together whereby the outer numbers depicted on the outer ring 515 align with the ball compartments of the separator ring 525. The time control return unit 505 may work using air or liquid displacement and the return of the selected medium through a diaphragm; or the displacement may be returned to static state by a spring force. The speed of movement may be governed by the interference of a seal positioned against an inside of the housing.

To ensure proper alignment of the roulette numbers and ball compartments, in each of the aforementioned embodiments, the alignment mechanism is mounted precisely such that the alignment mechanism finally engages with the positioning devices (e.g., spaces defined by pins, cavities, etc.), the corresponding roulette numbers are aligned with the ball compartments.

The use of two sets of roulette numbers creates new wager options for players. While roulette is a successful table game, it has remained the same since its inception and does suffer from staleness. The embodiments of the present invention increase the excitement of the game by providing the new wager options including a wager have a much larger payout over the payouts associated with conventional roulette.

FIG. 7 shows an exemplary roulette wager layout 600 according to the embodiments of the present invention. The layout 600 includes two identical number wager areas 605, 610, two outside combination wager areas 615, 620 and a bonus wager area 625.

Number wager area 605 refers to an inner set of roulette numbers while number wager area 610 refers to an outer set of roulette numbers or vice versa. Wagers placed in either number wager area 605, 610 require a single outcome to occur relative to which set of numbers the number wager area 605, 610 corresponds. Exemplary payouts 607 associated with wagers placed in either number wager area 605, 610 generally match conventional payouts. Specifically, any twelve numbers (A) results in a 2 to 1 payout, any six numbers (B) results in a 5 to 1 payout, any four numbers (C) results in an 8 to 1, any three numbers (D) results in an 11 to 1 payout, any two numbers (E) results in a 17 to 1 payout, any single number (F) results in a 35 to 1 payout, and any seven numbers (G) results in a 4 to 1 payout (with zero and double zero any eight numbers results in a payout of 3 to 1).

The outside combination wager areas 615, 620 require two events, one relative to each set of roulette numbers, to occur to result in a payout. Exemplary payouts 606 are associated with the combination wager area 615. A successful wager placed on two red outcomes, two black outcomes, two even outcomes, two odd outcomes, two 1-18 outcomes and two 19-36 outcomes results in a 3 to 1 payout. Exemplary payouts 607 refer to any two eight numbers (includes zero and double zero) or seven numbers (includes single zero only) whereby successful wagers placed as designated by the star 613 result in payouts of 18 to 1 and 25 to 1, 612 respectively.

The outside combination wager areas 615, 620 require two events, one relative to each set of roulette numbers, to occur to result in a payout. Exemplary payouts 608 are associated with the combination wager area 620. A successful wager placed on any two first dozen (1-12), any two second dozen (13-24), any two third dozen (25-36), any two first column (numbers 1, 2, 7, 8, 13, 14, 19, 20, 25, 26, 21 and 32), any two second column (numbers 3, 4, 9, 10, 15, 16, 21, 22, 27, 28 33 and 34), and any two third column (5, 6, 11, 12, 17, 18, 23, 24, 29, 30, 35 and 36) results in an 8 to 1 payout.

Bonus wager are 625 allows players to place wagers on the prospect of a ball compartment being identified by the same number on each the outer ring and inner unit. Successful wagers on such an outcome result in a payout of 1200 to 1 611. The largest payout associated with conventional roulette is number wagers which pay 35 to 1. Accordingly, the 1200 to 1 payout enhances tremendously the amount of money a player can win on a single wager.

In one embodiment, the roulette numbers are depicted in reverse order on the outer ring and cone assembly. Those skilled in the art will recognize that the roulette numbers may be depicted in any order desired by the manufacturer and/or operator.

While the embodiments of the present invention are ideal for live roulette tables, they are also suitable for automated electronic roulette games and video-based roulette games. Automated roulette games have become increasingly popular. Such automated roulette games include a concealed system for automatically spinning the roulette wheel and roulette ball. Players place wagers on linked terminals. Other systems may use a dealer to spin the roulette wheel and roulette ball while players place wagers via linked terminals. In either instance, or others involving automated features, the embodiments of the present invention can be used to enhance the systems. Similarly, the dual number outcomes and additional wagering options are very suitable for video-based roulette games whether facilitated by stand alone slot-type machines or online systems accessible by electronic devices (e.g., desktop computer, laptop computer and hand-held device).

Figure 8:
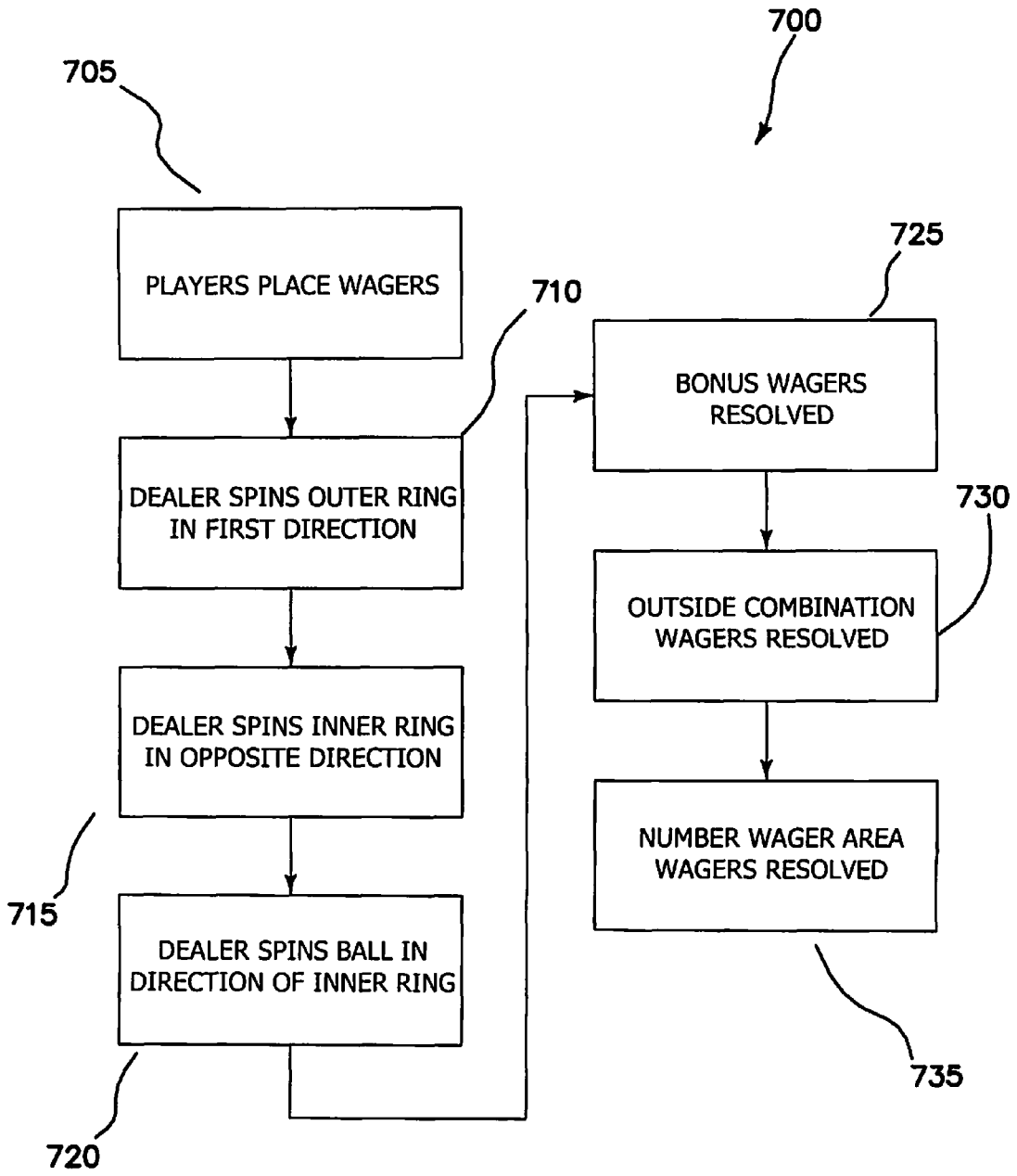
FIG. 8 illustrates a flow chart detailing one method of utilizing the roulette wheel systems according to the embodiments of the present invention.

Flow chart 700 shown in FIG. 8 details an exemplary methodology for utilizing the roulette wheel systems described herein. At 705, players place wagers on one or both number wager areas 605, 610, two outside combination wager areas 615, 620 and/or the bonus wager area 625. At 710, a dealer spins the outer ring in a first direction. At 715, a dealer spins the inner unit in an opposite direction. Both the outer ring and the inner unit may be spun in the same direction as well. Spinning the inner unit may be accomplished using a turret or placing one or more fingers in the ball compartments while spinning the outer ring may be accomplished by depressing one or more fingers on the outer number section.

At 720, the ball in spun in a direction opposite to the direction of the outer ring (i.e., direction of the inner ring). The roulette ball may be spun in the same direction as the outer ring as well. At 725, once the roulette ball comes to rest in a ball compartment, the dealer resolves wagers placed in the bonus wager area. At 730, the dealer resolves wagers placed in the outside combination wager area. At 735, the dealer resolves wagers placed in the number wager area. It should be understood that the wagers may be resolved in any order desired by the operator and which limits to the risk of cheating.

While the descriptions above focus on a single alignment mechanism, in each of the embodiments of the present invention multiple alignment mechanisms (e.g., 2 or 3 cylindrical plungers) may be used to ensure alignment of the roulette numbers with the ball compartments.

Although the invention has been described in detail with reference to several embodiments, additional variations and modifications exist within the scope and spirit of the invention.

We claim:

1. A roulette wheel system comprising:

a base containing:

a separator ring having a series of roulette ball compartments, said separator ring rotatable within said base;

a cone assembly supported by the separator ring, said cone assembly including a first series of roulette numbers depicted on an outer perimeter thereof;

an outer ring including a second series of roulette numbers, said outer ring rotatable within said base; and one or more cylindrical plungers mounted to said outer ring, each of said one or more cylindrical plungers including a spring for biasing a bearing of each of said one or more cylindrical plungers into contact with recesses associated with said separator ring to cause said second series of roulette numbers to align with said ball compartments, said bearing of each one or more cylindrical plungers configured to rotate when in contact with said separator ring.

2. The system of claim 1 wherein said bearing is oriented horizontally such that bearing rotation is in a horizontal plane.

3. The system of claim 1 wherein said one or more cylindrical plungers includes an adjuster cap for changing the biasing force exerted by the spring.

4. A roulette wheel system comprising:

a base containing:

a separator ring having a series of roulette ball compartments, said separator ring rotatable within said base;

a cone assembly supported by the separator ring, said cone assembly including a first series of roulette numbers depicted on an outer perimeter thereof;

an outer ring including a second series of roulette numbers, said outer ring rotatable within said base; and one or more ball plunger assemblies mounted to said outer ring, each of said one or more ball plunger assemblies including a spring for biasing an integral ball into contact with spaced cavities integrated on said separator ring to cause said second series of roulette numbers to align with said ball compartments.

5. The system of claim 4 wherein said one or more ball plunger assemblies are horizontally positioned and said cavities are integrated in an outer edge of the separator ring.

6. The system of claim 4 wherein said one or more ball plunger assemblies are vertically positioned and said cavities are integrated in an under surface of the separator ring.

7. A roulette wheel system comprising:

a base containing:

a separator ring having a series of roulette ball compartments, said separator ring rotatable within said base;

a cone assembly supported by the separator ring, said cone assembly including a first series of roulette numbers depicted on an outer perimeter thereof;

an outer ring including a second series of roulette numbers, said outer ring rotatable within said base; and one or more centrifugal clutch members slidably mounted to said separator ring, each of said one or more clutch members including a serrated edge configured to contact a corresponding serrated edge of a bearing hub of said outer ring to cause said second series of roulette numbers to align with said ball compartments, whereby peaks of serrated edges of said clutch members mate with valleys of said serrated edge of said bearing hub.

8. The system of claim 7 wherein said one or more clutch members are mounted to an arm of said separator ring.

9. The system of claim 8 wherein said arms are sloped inward.

10. The system of claim 7 further comprising a biased-spring configured to force the centrifugal clutch member into engagement with said bearing hub.

11. A roulette wheel system comprising:

a base containing:

a separator ring having a series of roulette ball compartments, said separator ring rotatable within said base;

a cone assembly supported by the separator ring, said cone assembly including a first series of roulette numbers depicted on an outer perimeter thereof;

an outer ring including a second series of roulette numbers, said outer ring rotatable within said base; and a time control return unit configured to disengage the separator ring and outer ring allowing the separator ring and outer ring to rotate independently of one another for a pre-established time period and thereafter automatically engage the separator ring and outer ring causing the separator ring and outer ring to rotate dependently with the first series of roulette numbers and second series of roulette numbers aligned with the ball compartments.

12. The roulette wheel system of claim 11 wherein said time control return unit is positioned within a roulette wheel system turret.

13. The roulette wheel system of claim 12 wherein said time control unit comprises an air or liquid diaphragm.

* * * * *